US011230744B2

(12) United States Patent
Nakagaito et al.

(10) Patent No.: US 11,230,744 B2
(45) **Date of Patent: *Jan. 25, 2022**

(54) STEEL SHEET, PLATED STEEL SHEET, METHOD FOR PRODUCING HOT-ROLLED STEEL SHEET, METHOD FOR PRODUCING COLD-ROLLED FULL HARD STEEL SHEET, METHOD FOR PRODUCING STEEL SHEET, AND METHOD FOR PRODUCING PLATED STEEL SHEET

(71) Applicant: JFE STEEL CORPORATION, Tokyo (JP)

(72) Inventors: Tatsuya Nakagaito, Tokyo (JP); Yoshimasa Funakawa, Tokyo (JP); Yoshihiko Ono, Tokyo (JP); Hiroshi Hasegawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 156 days.

This patent is subject to a terminal disclaimer.

(21) Appl. No.: 16/089,051

(22) PCT Filed: Jan. 16, 2017

(86) PCT No.: PCT/JP2017/001236

§ 371 (c)(1),
(2) Date: Sep. 27, 2018

(87) PCT Pub. No.: WO2017/168957

PCT Pub. Date: Oct. 5, 2017

(65) Prior Publication Data

US 2019/0112681 A1 Apr. 18, 2019

(30) Foreign Application Priority Data

Mar. 31, 2016 (JP) ..... JP2016-070747
Nov. 10, 2016 (JP) ..... JP2016-219339

(51) Int. Cl.
*C21D 8/02* (2006.01)
*C22C 38/04* (2006.01)
(Continued)

(52) U.S. Cl.
CPC ..... *C21D 8/0226* (2013.01); *C21D 8/0236* (2013.01); *C21D 8/0273* (2013.01);
(Continued)

(58) Field of Classification Search
None
See application file for complete search history.

(56) References Cited

U.S. PATENT DOCUMENTS

2013/0269838 A1 10/2013 Kawano et al.
2015/0017472 A1 1/2015 Kimura et al.
2015/0059912 A1 3/2015 Shimamura et al.

FOREIGN PATENT DOCUMENTS

CN 101641456 A 2/2010
CN 102770568 A 11/2012
(Continued)

OTHER PUBLICATIONS

Apr. 4, 2020 Office Action issued in Korean Patent Application No. 10-2018-7027656.
(Continued)

*Primary Examiner* — Anthony M Liang
(74) *Attorney, Agent, or Firm* — Oliff PLC

(57) ABSTRACT

A steel sheet having excellent fatigue resistance as a material for automobile parts and a TS of 590 MPa or more, and a method for producing the same. The steel sheet has a composition comprising, by mass %, C: 0.04% or more and 0.15% or less, Si: 0.3% or less, Mn: 1.0% or more and 2.6% or less, P: 0.1% or less, S: 0.01% or less, Al: 0.01% or more and 0.1% or less, N: 0.015% or less, one or two of Ti and Nb: 0.01% or more and 0.2% or less in a total, and the balance
(Continued)

being Fe and unavoidable impurities. The steel sheet has 50% or more of ferrite and 10% or more and 50% or less of martensite in terms of an area ratio, and a microstructure in which a standard deviation of nano-hardness is 1.50 GPa or less and tensile strength of 590 MPa or more.

21 Claims, 1 Drawing Sheet

(51) Int. Cl.

| | |
|---|---|
| ***C22C 38/02*** | (2006.01) |
| ***C22C 38/06*** | (2006.01) |
| ***C22C 38/00*** | (2006.01) |
| ***C22C 38/12*** | (2006.01) |
| ***C22C 38/14*** | (2006.01) |
| ***C23C 2/06*** | (2006.01) |
| ***C23C 2/28*** | (2006.01) |
| ***C23C 2/40*** | (2006.01) |
| ***C21D 9/46*** | (2006.01) |
| ***C22C 38/60*** | (2006.01) |
| ***C22C 38/26*** | (2006.01) |
| ***C22C 38/28*** | (2006.01) |
| ***C22C 38/38*** | (2006.01) |
| *C22C 18/00* | (2006.01) |
| *C22C 18/04* | (2006.01) |
| *C22C 38/22* | (2006.01) |
| *C22C 38/24* | (2006.01) |

(52) U.S. Cl.

CPC ..... *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/26* (2013.01); *C22C 38/28* (2013.01); *C22C 38/38* (2013.01); *C22C 38/60* (2013.01); *C23C 2/06* (2013.01); *C23C 2/28* (2013.01); *C23C 2/40* (2013.01); *C21D 2211/005* (2013.01); *C21D 2211/008* (2013.01); *C22C 18/00* (2013.01); *C22C 18/04* (2013.01); *C22C 38/22* (2013.01); *C22C 38/24* (2013.01)

(56) References Cited

FOREIGN PATENT DOCUMENTS

| | | | | |
|---|---|---|---|---|
| CN | 102918174 | A | | 2/2013 |
| CN | 103140596 | A | | 6/2013 |
| CN | 104093873 | A | | 10/2014 |
| CN | 105829563 | A | | 8/2016 |
| CN | 106661658 | A | | 5/2017 |
| EP | 2128295 | A1 | | 12/2009 |
| EP | 2540854 | A1 | | 1/2013 |
| EP | 2578718 | A1 | | 4/2013 |
| EP | 2623629 | A1 | | 8/2013 |
| EP | 2811047 | A1 | | 12/2014 |
| EP | 2 998 416 | A1 | | 3/2016 |
| EP | 3085802 | A1 | | 10/2016 |
| EP | 3173494 | A1 | | 5/2017 |
| JP | S58-22332 | A | | 2/1983 |
| JP | H11-92859 | A | | 4/1999 |
| JP | H11-350038 | A | | 12/1999 |
| JP | 2002-241897 | A | | 8/2002 |
| JP | 2004-149812 | A | | 5/2004 |
| JP | 2006-152362 | A | | 6/2006 |
| JP | 2006152362 | A | * | 6/2006 |
| JP | 2007-092126 | A | | 4/2007 |
| JP | 2009-203492 | A | | 9/2009 |
| JP | 2010-126747 | A | | 6/2010 |
| JP | 2011-111670 | A | | 6/2011 |
| JP | 2013-177673 | A | | 9/2013 |
| JP | 2013-227670 | A | | 11/2013 |
| JP | 2015-147968 | A | | 8/2015 |
| JP | 5884210 | B1 | | 3/2016 |
| WO | 2012/053044 | A1 | | 4/2012 |
| WO | 2015/015739 | A1 | | 2/2015 |
| WO | 2015/092987 | A1 | | 6/2015 |

OTHER PUBLICATIONS

Dec. 17, 2018 Extended Search Report issued in European Patent Application No. 17773507.3.

Jun. 5, 2018 Office Action issed in Japanese Patent Application No. 2017-097765.

Oct. 10, 2019 Office Action issued in Korean Patent Application No. 10-2018-7027656.

Feb. 21, 2020 Office Action issued in Chinese Patent Application No. 201780020538.0.

Mar. 14, 2017 International Search Report issued in International Application No. PCT/JP2017/001236.

Sep. 14, 2020 Office Action issued in Chinese Patent Application No. 201780020538.0.

Apr. 6, 2021 Office Action issued in Chinese Patent Application No. 201780020538.0.

Mar. 31, 2021 Office Action issued in U.S. Appl. No. 16/086,044.

Nov. 10, 2020 Office Action issued in U.S. Appl. No. 16/086,044.

* cited by examiner

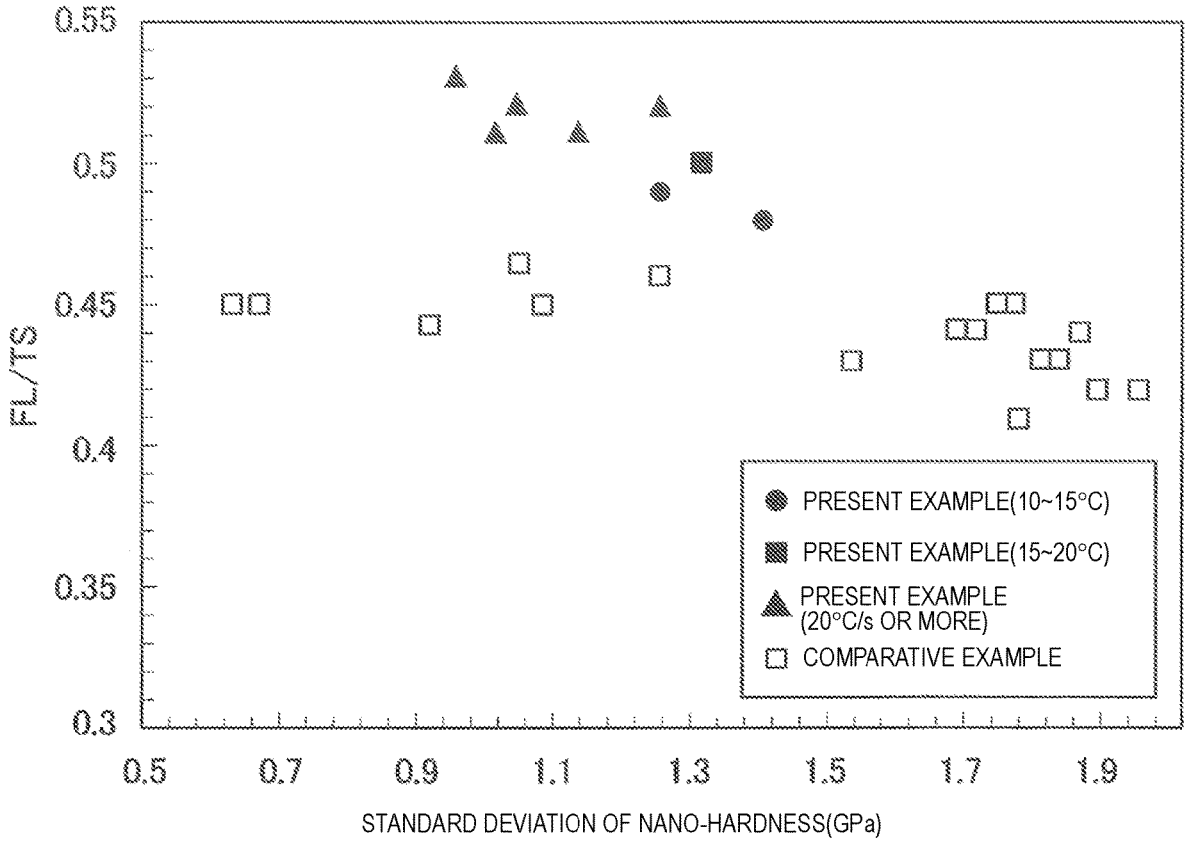
0.55
0.5
0.45
0.4
0.35
0.3
FL/TS
0.5
0.7
0.9
1.1
1.3
1.5
1.7
1.9
STANDARD DEVIATION OF NANO-HARDNESS(GPa)
PRESENT EXAMPLE(10~15°C)
PRESENT EXAMPLE(15~20°C)
PRESENT EXAMPLE (20°C/s OR MORE)
COMPARATIVE EXAMPLE

STEEL SHEET, PLATED STEEL SHEET, METHOD FOR PRODUCING HOT-ROLLED STEEL SHEET, METHOD FOR PRODUCING COLD-ROLLED FULL HARD STEEL SHEET, METHOD FOR PRODUCING STEEL SHEET, AND METHOD FOR PRODUCING PLATED STEEL SHEET

TECHNICAL FIELD

This application relates to steel sheets, plated steel sheets, a method for producing hot-rolled steel sheets, a method for producing cold-rolled full hard steel sheets, a method for producing steel sheets, and a method for producing plated steel sheets.

BACKGROUND

In recent years, improvement of fuel economy of automobiles has become an important issue in view of global environment conservation. For this reason, development has been aggressively carried out to reduce the wall thickness of automobiles by increasing the strength of materials therefore so as to reduce the weight of the automobile body itself. However, the increase in the strength of the steel sheet leads to a decrease in ductility, that is, a decrease in forming workability, and therefore development of a material having both high strength and high workability is desired. To meet such demands, dual-phase steel (DP steel) of ferrite and martensite has been developed so far.

For example, PTL 1 discloses DP steel having high ductility, and PTL 2 discloses DP steel having excellent stretch flange formability as well as ductility.

However, since such DP steel has a composite microstructure of a hard phase and a soft phase as a basic microstructure, it has a problem that fatigue properties is inferior, which is an obstacle to practical application at a site where fatigue properties are required.

To cope with such a problem, PTL 3 discloses a technique for improving fatigue resistance of DP steel by forming a fine DP microstructure in a manner of adding Ti and Nb in large amounts to inhibit recrystallization of ferrite during annealing, heating the steel to a temperature equal to or higher than an $A_3$ transformation temperature, and then cooling it to an Ms point or lower after retaining it for 60 seconds or longer in a dual-phase region of ferrite and austenite during cooling.

CITATION LIST

Patent Literature

PTL 1: JP-A-58-22332
PTL 2: JP-A-11-350038
PTL 3: JP-A-2004-149812

SUMMARY

Technical Problem

In the method of production disclosed in PTL 3, however, it is necessary to add a large amount of Ti or Nb, which is disadvantageous in terms of cost, and further requires a high annealing temperature equal to or higher than the $A_3$ point and retention in the course of cooling, resulting in causing a large problem in manufacturability. The steel sheet disclosed in PTL 3 has tensile strength of 700 MPa or less, and thus it is necessary to further increase the strength for reduction in the weight of automobiles.

The disclosed embodiments have been made under these circumstances, and it is an object of the disclosed embodiments to provide a steel sheet having excellent fatigue resistance as a material for automobile parts and a TS of 590 MPa or more, and a method for producing the steel sheet. The disclosed embodiments are also intended to provide a plated steel sheet obtained by plating of the steel sheet, a method for producing a hot-rolled steel sheet needed to obtain the steel sheet, a method of producing a cold-rolled full hard steel sheet, and a method for producing the plated steel sheet.

Solution to Problem

The present inventors conducted intensive studies from the viewpoint of a composition and a microstructure of a steel sheet to produce a steel sheet having excellent fatigue resistance using a continuous annealing line or a continuous hot-dip galvanizing line. Consequently, the inventors found that a steel sheet having excellent fatigue resistance could be obtained in which an area ratio is 50% or more of ferrite and 10% or more of martensite and a standard deviation of nano-hardness in a steel sheet microstructure is 1.50 GPa or less.

The nano-hardness is the hardness measured by applying a load of 1,000 μN using TRIBOSCOPE manufactured by Hysitron Inc. In particular, approximately 50 points, approximately 7 lines each including 7 points disposed with pitches of 5 μm were measured, and the standard deviation thereof was obtained. Details are described in examples.

As a method for measuring the hardness of a microstructure, the Vickers hardness is famous. However, the minimum value of a loading weight according to the Vickers hardness measurement is about 0.5 gf and, even in the case of hard martensite, the indentation size is 1 to 2 μm, so that the hardness of a fine phase can hardly be measured. That is, since it is difficult to measure the hardness of each phase in the Vickers hardness measurement, hardness measurement including both soft and hard phases such as martensite and ferrite is performed. On the other hand, the hardness of a fine phase can be measured in the nano-hardness measurement, so the hardness of each phase can be measured. As a result of intensive studies, the present inventors found that fatigue strength was improved by decreasing the standard deviation of the nano-hardness, that is, by increasing the hardness of the soft phase to make the hardness distribution in the microstructure.

The disclosed embodiments were completed based on these findings, and the configuration is as follows.

[1] A steel sheet of a composition comprising, in mass %, C: 0.04% or more and 0.15% or less, Si: 0.3% or less, Mn: 1.0% or more and 2.6% or less, P: 0.1% or less, S: 0.01% or less, Al: 0.01% or more and 0.1% or less, N: 0.015% or less, one or two selected from Ti and Nb: 0.01% or more and 0.2% or less in a total, and the balance being Fe and unavoidable impurities, wherein the steel sheet has a steel microstructure of 50% or more of ferrite and 10% or more and 50% or less of martensite in terms of an area ratio, and wherein a standard deviation of nano-hardness of the steel microstructure is 1.50 GPa or less, and wherein the steel sheet has a tensile strength of 590 MPa or more.

[2] The steel sheet according to item [1], wherein the composition further includes, in mass %, at least one selected from Cr: 0.05% or more and 1.0% or less, Mo: 0.05% or more and 1.0% or less, and V: 0.01% or more and 1.0% or less.

[3] The steel sheet according to item [1] or [2], wherein the composition further includes, in mass %, B: 0.0003% or more and 0.005% or less.

[4] The steel sheet according to any one of items [1] to [3], wherein the composition further includes, in mass %, at least one selected from Ca: 0.001% or more and 0.005% or less, and Sb: 0.003% or more and 0.03% or less.

[5] A plated steel sheet including a plating layer on a surface of the steel sheet of any one of items [1] to [4].

[6] The plated steel sheet according to item [5], wherein the plating layer is a hot-dip galvanized layer.

[7] The plated steel sheet according to item [6], wherein the hot-dip galvanized layer is a hot-dip galvannealed layer.

[8] A method for producing a hot-rolled steel sheet, including:

heating a steel slab of the composition of any one of items [1] to [4] to 1,200° C. or higher and 1,350° C. or lower and then subjecting the steel slab to finish rolling at a finish rolling temperature of 800° C. or higher; and subsequently coiling the hot-rolled steel sheet at a coiling temperature of 400° C. or higher and 650° C. or lower.

[9] A method for producing a cold-rolled full hard steel sheet, including:

cold rolling the hot-rolled steel sheet obtained by the method of item [8] at a cold-rolling reduction ratio of 30 to 95%.

[10] A method for producing a steel sheet, including:

heating the cold-rolled full hard steel sheet obtained by the method of item [9] up to a temperature of 730 to 900° C. at a dew point of −40° C. or lower in a temperature range of 600° C. or higher and at an average heating rate of 10° C./s or more in a temperature range from 500° C. to an $Ac_1$ transformation temperature;

retaining the heated cold-rolled full hard steel sheet for 10 seconds or longer; and subsequently cooling the cold-rolled full hard steel sheet from 750° C. to 550° C. at an average cooling rate of 3° C./s or more in a cooling step.

[11] A method for producing a plated steel sheet, including:

plating the steel sheet obtained by the method of item [10].

[12] The method according to item [11], wherein, the plating is a hot-dip galvanizing.

[13] The method according to item [12], further including:

alloying for 5 to 60 s in a temperature range of 480 to 560° C. after the hot-dip galvanizing.

Advantageous Effects

The disclosed embodiments enable producing a steel sheet having excellent fatigue properties with high strength of 590 MPa or more.

BRIEF DESCRIPTION OF DRAWINGS

FIG. 1 is a diagram representing a relationship between a standard deviation of nano-hardness and FL/TS in a microstructure of a steel sheet.

DETAILED DESCRIPTION

An embodiment of the disclosed embodiments is described below. The scope of this disclosure is not intended to be limited to any of the following specific embodiments.

The disclosed embodiments include a steel sheet, a plated steel sheet, a method for producing hot-rolled steel sheets, a method for Producing cold-rolled full hard steel sheets, a method for producing steel sheets, and a method for producing plated steel sheets. The following firstly describes how these are related to one another.

The steel sheet of the disclosed embodiments is produced from a starting steel material such as a slab through producing processes that produce a hot-rolled steel sheet and a cold-rolled full hard steel sheet. Further, the plated steel sheet of the disclosed embodiments is obtained by plating the steel sheet.

The method for producing a hot-rolled steel sheet of the disclosed embodiments is apart of the foregoing processes that produces a hot-rolled steel sheet.

The method for producing a cold-rolled full hard steel sheet of the disclosed embodiments is a part of the foregoing processes that produces a cold-rolled full hard steel sheet from the hot-rolled steel sheet.

The method for producing a steel sheet of the disclosed embodiments is a part of the foregoing processes that produces a steel sheet from the cold-rolled full hard steel sheet.

The method for producing a plated steel sheet of the disclosed embodiments is apart of the foregoing processes that produces a plated steel sheet from the steel sheet.

Because of these relationships, the hot-rolled steel sheet, the cold-rolled full hard steel sheet, and the steel sheet, plated steel sheet share the same composition. Likewise, the steel sheet and the plated steel sheet share the same steel microstructure. The following describes such common features first, followed by the hot-rolled steel sheet, the steel sheet, the plated steel sheet, and the methods of production of these members, in this order.

<Composition of Steel Sheet and Plated Steel Sheet>

The steel sheet and the plated steel sheet have a composition containing, in mass %, C: 0.04% or more and 0.15% or less, Si: 0.3% or less, Mn: 1.0% or more and 2.6% or less, P: 0.1% or less, S: 0.01% or less, Al: 0.01% or more and 0.1% or less, N: 0.015% or less, one or two of Ti and Nb: 0.01% or more and 0.2% or less in a total, and the balance being Fe and unavoidable impurities.

The composition may further contain, in mass %, at least one selected from Cr: 0.05% or more and 1.0% or less, Mo: 0.05% or more and 1.0% or less, and V: 0.01% or more and 1.0% or less.

The composition may contain, in mass %, B: 0.0003% or more and 0.005% or less.

The composition may contain, in mass %, at least one selected from Ca: 0.001% or more and 0.005% or less, and Sb: 0.003% or more and 0.03%.

The following describes each composition. In the following description, "%" representing the content of each composition means "mass %".

C: 0.04% or More and 0.15% or Less

Carbon (C) is an element that is necessary for martensite formation to form a DP microstructure. When the C content is less than 0.04%, a desired martensite amount is not obtained, whereas when the C content exceeds 0.15%, weldability deteriorates. For this reason, the C content is limited to the range of 0.04% or more and 0.15% or less. Preferably, the lower limit of the C content is 0.06% or more. Preferably, the upper limit of the C content is 0.12% or less.

Si: 0.3% or Less

Silicon (Si) is an element that is effective for strengthening steel. However, when the Si content exceeds 0.3%, fatigue properties of a steel sheet after annealing deteriorates due to a red scale occurring during hot rolling. For this reason, the Si content is 0.3% or less, preferably 0.1% or less.

Mn: 1.0% or More and 2.6% or Less

Manganese (Mn) is an element that is effective for strengthening steel. Further, Mn is an element that contributes to stabilize austenite and effectively acts to suppress pearlite and form martensite during cooling after annealing. For this reason, the Mn content is necessarily 1.0% or more. On the other hand, when Mn is contained in excess of 2.6%, martensite is excessively formed and deterioration of formability is caused. Therefore, the Mn content is 1.0% or more and 2.6% or less. The lower limit of the Mn content is preferably 1.4% or more. The upper limit of the Mn content is preferably 2.2% or less, more preferably less than 2.2%, further preferably 2.1% or less.

P: 0.1% or Less

Phosphorus (P) is an element that is effective for strengthening steel. When the P content exceeds 0.1%, deterioration in workability and toughness is caused. Accordingly, the P content is 0.1% or less.

S: 0.01% or Less

Sulfur (S) forms inclusions such as MnS to cause deterioration of formability, and therefore the content thereof is preferably as low as possible. However, the S content is 0.01% or less from the viewpoint of production costs.

Al: 0.01% or More and 0.1% or Less

Aluminum (Al) is an element that acts as a deoxidizing agent and is effective for cleanliness of steel, and is preferably added in a deoxidation process. In this process, such an effect is not achieved when the Al content is less than 0.01%, and therefore the lower limit is 0.01%. However, the excessive content of Al leads to deterioration of slab quality in a steelmaking process. Accordingly, the Al content is 0.1% or less.

N: 0.015% or Less

When the nitrogen (N) content exceeds 0.015%, coarse AlN increases inside the steel sheet and fatigue properties deteriorate. For this reason, the N content is 0.015% or less, preferably 0.010% or less.

One or two of Ti and Nb: 0.01% or more and 0.2% or less in total

Titanium (Ti) and niobium (Nb) form carbonitrides and act to increase the strength of steel by precipitation hardening. Further, recrystallization of ferrite is inhibited by precipitation of TiC and NbC, which leads to improvement of fatigue properties as described below. Such an effect can be obtained when the total content of Ti and Nb is 0.01% or more. When the total content of Ti and Nb exceeds 0.2%, the effect becomes saturated and deterioration of formability is caused. For this reason, the total content of Ti and Nb is 0.01% or more and 0.2% or less. The lower limit is preferably 0.03% or more. The upper limit is preferably 0.1% or less.

The steel sheet and the plated steel sheet of the disclosed embodiments have the basic composition described above.

The composition may contain at least one selected from Cr, Mo, and V, as needed.

Cr: 0.05% or More and 1.0% or Less, Mo: 0.05% or More and 1.0% or Less, V: 0.01% or More and 1.0% or Less Cr, Mo, and V are elements that are effective for increasing hardenability to strengthen steel. Such an effect can be obtained in a case of Cr: 0.05% or more, Mo: 0.05 or more, and V: 0.01% or more. However, when these elements are contained in amounts of Cr: exceeding 1.0%, Mo: exceeding 1.0%, and V: exceeding 1.0%, formability deteriorates. Therefore, the upper limits of the content of these elements are respectively 1.0% or less, if these elements are contained. The lower limit of the Cr content is further preferably 0.1% or more, and the upper limit thereof is further preferably 0.5% or less. The lower limit of the Mo content is further preferably 0.1% or more, and the upper limit thereof is further preferably 0.5% or less. The lower limit of the V content is further preferably 0.02% or more, and the upper limit thereof is further preferably 0.5% or less.

The composition may further contain boron (B), as needed.

B: 0.0003% or More and 0.005% or Less

Boron (B) is an element that has an effect of improving hardenability and can be contained as needed. Such an effect can be obtained when the B content is 0.0003% or more. However, the B content exceeds 0.005%, such an effect is saturated and costs increase. Accordingly, the B content is 0.0003% or more and 0.005% or less, if B is contained. The lower limit thereof is further preferably 0.0005% or more. The upper limit thereof is further preferably 0.003% or less.

The composition may further contain at least one selected from Ca and Sb, as needed.

Ca: 0.001% or More and 0.005% or Less

Calcium (Ca) is an element that is effective for decreasing an adverse effect of sulfides on formability by spheroidizing sulfides. In order to obtain such an effect, it is necessary that the Ca content is 0.001% or more. Meanwhile, when the Ca content is excessive, inclusions increase, resulting in causing surface and internal defects, for example. Accordingly, the Ca content is 0.001% or more and 0.005% or less, if Ca is contained.

Sb: 0.003% or More and 0.03% or Less

Antimony (Sb) has an effect of inhibiting decarburization on a surface layer of the steel sheet and improving fatigue properties. In order to obtain such an effect, the Sb content is preferably 0.003% or more. However, when the Sb content exceeds 0.03%, the rolling load increases at the time of production of the steel sheet, whereby productivity may deteriorate. Therefore, the Sb content is 0.003% or more and 0.03% or less, if Sb is contained. The lower limit is further preferably 0.005% or more. The upper limit is further preferably 0.01% or less.

The balance is Fe and unavoidable impurities.

The microstructure of the steel sheet and the plated steel sheet are described below.

Area Ratio of Ferrite: 50% or More

In order to obtain excellent ductility, an area ratio of ferrite relative to the entire steel sheet is required to be 50% or more, preferably 60% or more.

Area Ratio of Martensite: 10% or More and 50% or Less

Martensite acts to increases the strength of steel and is required to have an area ratio of 10% or more relative to the entire steel sheet in order to obtain the desired strength. However, when the area ratio exceeds 50%, the strength excessively increases and formability deteriorates. For this reason, the area ratio of martensite is 10% or more and 50% or less. The lower limit is preferably 15% or more. The upper limit is preferably 40% or less.

The total of ferrite and martensite is preferably 85% or more.

The steel sheet of the disclosed embodiments may include, for example, a bainite phase, a residual austenite phase, or a pearlite phase in addition to the phases described above. However, the residual austenite is preferably less than 3.0%, further preferably 2.0% or less.

Standard Deviation of Nano-hardness in Steel Sheet Microstructure: 1.50 GPa or less When the standard deviation of the nano-hardness exceeds 1.50 GPa, desired fatigue properties cannot be obtained, so it is 1.50 GPa or less. It is preferably 1.3 GPa or less. The standard deviation σ is obtained from n pieces of hardness data x using formula (1):

$$\sigma=(\text{Square root})((n\Sigma x^2-(\Sigma x)^2)/(n(n-1))) \quad (1)$$

<Steel Sheet>

The composition and the steel microstructure of the steel sheet are as described above. In addition, the thickness of the steel sheet is not particularly limited, and is typically 0.7 to 2.3 mm.

<Plated Steel Sheet>

The plated steel sheet of the disclosed embodiments is a plated steel sheet including a plating layer on a surface of the steel sheet of the disclosed embodiments. The plating layer is not particularly limited, and may be, for example, a hot-dip plating layer or an electroplating plating layer. Further, the plating layer may also be an alloyed plating layer. The plating layer is preferably a galvanized layer. The galvanized layer may contain Al or Mg. Hot-dip zinc-aluminum-magnesium alloy plating (Zn—Al—Mg plating layer) is also preferred. In this case, the Al content is preferably 1 mass % or more and 22 mass % or less, and the Mg content is preferably 0.1 mass % or more and 10 mass % or less. The Zn—Al—Mg plating layer also may contain at least one selected from Si, Ni, Ce, and La in a total amount of 1 mass % or less. The plated metal is not particularly limited, and metals such as aluminum may be plated, other than zinc described above.

The composition of the plating layer is not particularly limited, and the plating layer may have a common composition. For example, the plating layer may preferably be a hot-dip galvanized layer with the plating metal in an amount of deposition of 20 to 80 g/m$^2$ for each side, or a hot-dip galvannealed layer produced as an alloyed layer of such plating layers. When the plating layer is a hot-dip galvanized layer, the Fe content in the plating layer is less than 7 mass %. In the case of a hot-dip galvannealed layer, the Fe content in the plating layer is 7 to 15 mass %.

<Method for Producing Hot-Rolled Steel Sheet>

Production conditions will be described below.

In a method for producing a hot-rolled steel sheet of the disclosed embodiments, a steel having the above-described composition for the "steel sheet and the plated steel sheet" is melted using a converter or the like and is then cast into a slab by a continuous casting method or the like. The slab is subjected hot rolling to make a hot-rolled steel sheet, the hot-rolled steel sheet is subjected to pickling and cold rolling to make a cold-rolled full hard steel sheet, and the cold-rolled full hard steel sheet is subjected to continuous annealing. When the surface of the steel sheet is not subjected to plating, annealing is performed in a continuous annealing line (CAL), and when the surface is subjected to hot-dip galvanizing or hot-dip galvannealing, annealing is performed in a continuous hot-dip galvanizing line (CGL).

Each of the conditions will be described. In the following description, the temperature means a surface temperature of the steel sheet unless otherwise specified. The surface temperature of the steel sheet may be measured using, for example, a radiation thermometer. The average cooling rate is represented by ((surface temperature before cooling—surface temperature after cooling)/cooling time).

Production of Steel Slab

The melting method for production of the steel slab is not particularly limited, and various known melting methods may be used, including, for example, a method using a converter and a method using an electric furnace. It is also possible to perform secondary refining with a vacuum degassing furnace. Subsequently, the slab (steel material) may be produced preferably by a known continuous casting method from the viewpoint of productivity and quality. Further, the slab may be produced using known casting methods such as ingot casting-blooming and thin-slab continuous casting.

Hot-Rolling Condition

The hot-rolling conditions of the disclosed embodiments are as follows:

Heating the steel slab at a temperature of 1,200° C. or higher and 1,350° C. or lower; subjecting the steel slab to finish rolling at a finish rolling temperature of 800° C. or higher; and then coiling the finish-rolled steel slab at a coiling temperature of 400° C. or higher and 650° C. or lower.

Slab Heating Temperature: 1,200° C. or Higher and 1,350° C. or Lower

Ti and Nb exist in the form of coarse TiC and NbC in the state of slab, and TiC and NbC are necessary to be finely reprecipitated during hot rolling by melting it once. For this reason, it is necessary to set the slab heating temperature to 1,200° C. or higher. When heating temperature exceeds 1,350° C., the yield deteriorates due to excessive generation of scales, so the slab heating temperature is 1, 200° C. or higher and 1, 350° C. or lower. The lower limit of the heating temperature is preferably 1,230° C. or higher. The upper limit of the heating temperature is preferably 1,300° C. or lower.

Finish Rolling Temperature: 800° C. or Higher

When the finish rolling temperature falls below 800° C., ferrite is generated during rolling, and thus TiC and NbC to be precipitated become coarse, whereby the standard deviation of the nano-hardness in the steel microstructure can hardly be 1.50 GPa or less. Accordingly, the finish rolling temperature is 800° C. or higher, preferably 830° C. or higher.

Coiling Temperature: 400° C. or Higher and 650° C. or Lower

When the coiling temperature is in the range of 400° C. or higher and 650° C. or lower, the standard deviation of the nano-hardness in the steel microstructure can be 1.50 GPa or less. When the coiling temperature exceeds 650° C., the reprecipitated TiC and NbC become coarse and thus recrystallization of ferrite is not effectively suppressed during annealing. When the coiling temperature is lower than 400° C., the shape of the hot-rolled sheet deteriorates or the hot-rolled sheet is excessively quenched, resulting in being in a non-uniform state. In either case, the standard deviation of the nano-hardness in the steel microstructure can hardly be 1.50 GPa or less. Therefore, the coiling temperature is 400° C. or higher and 650° C. or lower. The lower limit of the coiling temperature is preferably 450° C. or higher. The upper limit of the coiling temperature is preferably 600° C. or lower.

<Method for Producing Cold-Rolled Full Hard Steel Sheet>

A method for producing a cold-rolled full hard steel sheet of the disclosed embodiments is a method for performing cold rolling on the hot-rolled steel sheet obtained by the above-described method.

In the cold rolling conditions, the cold-rolling ratio is necessary to be 30% or more in order to uniformalize microstructures and to make the standard deviation of nano-hardness in the steel microstructure 1.50 GPa or less. However, when the cold-rolling reduction ratio exceeds 95%, the rolling load excessively increases and productivity decreases. Accordingly, the cold-rolling ratio is 30 to 95%. The lower limit of the cold-rolling ratio is preferably 40% or more. The upper limit of the cold-rolling ratio is preferably 70% or less.

Pickling may be performed before the cold rolling. The pickling conditions may be appropriately set.

<Method for Producing Steel Sheet>

A method for producing a steel sheet of the disclosed embodiments is a method that includes: heating the cold-rolled full hard steel sheet obtained by the above-described method up to a temperature of 730 to 900° C. at a dew point of −40° C. or lower in a temperature range of 600° C. or higher and at an average heating rate of 10° C./s or more in a temperature range from 500° C. to an $Ac_1$ transformation temperature; retaining the heated cold-rolled full hard steel sheet for 10 seconds or longer; and subsequently cooling the cold-rolled full hard steel sheet from 750° C. to 550° C. at an average cooling rate of 3° C./s or more in a cooling step.

Average Heating Rate in Temperature Range from 500° C. to $Ac_1$ Transformation Temperature: 10° C./s or More When the average heating rate is 10° C./s or more in the recrystallization temperature range from 500° C. to the $Ac_1$ transformation temperature in the steel of the disclosed embodiments, reverse transformation from an a-phase to a y-phase occurs while recrystallization of ferrite is inhibited at the time of heating up. As a result, the microstructure of the steel becomes a dual-phase microstructure of non-recrystallized ferrite and austenite, and becomes a DP microstructure of non-recrystallized ferrite and martensite after annealing. Such a non-recrystallized ferrite has more dislocations in the grain the recrystallized ferrite and has high hardness, whereby the standard deviation of the nano-hardness becomes small and fatigue resistance is improved. The strengthening of ferrite in the DP microstructure inhibits the occurrence and progress of fatigue cracks and effectively contributes to improve fatigue properties. The average heating rate in the range from 500° C. to the $Ac_1$ transformation temperature is preferably 15° C./s or more, further preferably 20° C./s or more.

Heating from 730 to 900° C. and Retention for 10 seconds or Longer

When the heating temperature is lower than 730° C. or the retention time is shorter than 10 seconds, re-austenization becomes insufficient and a desired amount of martensite cannot be obtained after annealing. On the other hand, when heating temperature exceeds 900° C., re-austenization excessively progresses, whereby non-recrystallized ferrite decreases, and the fatigue resistance of the steel sheet deteriorates after annealing. For this reason, the heating condition is 10 seconds or longer at the temperature of 730° C. to 900° C., preferably 30 seconds or longer at the temperature of 760° C. to 850° C.

The heating rate in the temperature range of the $Ac_1$ transformation temperature or higher is not particularly limited.

Average Cooling Rate in Temperature Range from 750° C. to 550° C.: 3° C./s or More When the average cooling rate is less than 3° C./s, pearlite is formed during cooling and a desired amount of martensite cannot be obtained after annealing, whereby the average cooling rate is 3° C./s or more, preferably 5° C./s or more.

Dew Point in Temperature Range of 600° C. or Higher: −40° C. or Lower

When the dew point is −40° C. or lower in a temperature range of 600° C. or higher, it is possible to inhibit decarburization from the surface of the steel sheet during annealing, and to stably achieve the specified tensile strength of 590 MPa or more of the disclosed embodiments. In the case of a high dew point where the dew point is higher than −40° C. in the temperature range of 600° C. or higher, the strength of the steel sheet may fall below 590 MPa due to decarburization from the surface of the steel sheet. For this reason, the dew point in the temperature range of 600° C. or higher is −40° C. or lower. The lower limit of the dew point of the atmosphere is not particularly specified. However, the dew point is preferably −80° C. or higher because the effect becomes saturated when the dew point is lower than −80° C., and poses cost disadvantages. The temperature in the above-described temperature range is based on the surface temperature of the steel sheet. Specifically, the dew point is adjusted in the above-described range when the surface temperature of the steel sheet is in the above-described temperature range.

<Method for Producing Plated Steel Sheet>

A method for producing a plated steel sheet of the disclosed embodiments is a method by which the steel sheet obtained above is plated. Plating may be, for example, a hot-dip galvanizing process, or a process that involves alloying after hot-dip galvanizing. Annealing and galvanizing may be continuously performed on the same line. The plating layer may be formed by electroplating such as electroplating of a Zn—Ni alloy, or may be formed by hot-dip plating of a zinc-aluminum-magnesium alloy. Preferred is galvanizing, as as shown in the above description regarding the plating layer. It is, however, possible to perform plating using other metals such as aluminum.

Although the plating conditions are not particularly limited, in the case of performing the hot-dip galvanizing, the alloying condition after hot-dip galvanizing is preferably 5 to 60 s in the temperature range of 480 to 560° C. When the temperature is lower than 480° C. or the time is shorter than 5 s, the alloying of the plating does not sufficiently proceed. Conversely, when the temperature exceeds 560° C. or the time exceeds 60 s, the alloying excessively proceeds and the powdering property of the plating deteriorates. For this reason, the alloying conditions are 480 to 560° C. and 5 to 60 s, preferably 500 to 540° C. and 10 to 40 s.

From the viewpoint of plating properties, it is preferable to set the dew point of heating and retention band in the CGL to −20° C. or lower.

EXAMPLES

Example 1

Steels of the compositions shown in Table 1 were melted with a converter, and prepared into a slab by continuous casting. The steel slabs were subjected to hot rolling under the conditions shown in Table 2 to produce hot-rolled steel sheets having a thickness of 3.0 mm. After pickling, the steel sheets were cold rolled to a thickness of 1.4 mm to obtain cold-rolled steel sheets. The hot-rolled steel sheets and the cold-rolled steel sheets were annealed. Annealing was performed in a continuous annealing line (CAL) for producing non-plated steel sheets, and performed in a continuous hot-dip galvanizing line (CGL) for producing hot-dip galvanized steel sheets and hot-dip galvannealed steel sheets. Table 2 shows the conditions of CAL and CGL. As for conditions of the hot-dip galvanizing treatment, the steel sheets were dipped in a plating bath at a bath temperature of 475° C. and then pulled up, and a depositing weight of the plating was adjusted variously by gas wiping. For some of the steel sheets, alloying was performed under conditions shown in Table 2. The $Ac_1$ transformation temperature was obtained from the following formula described in page 43 of "Metallurgical Materials", (1985, Maruzen), edited by The Japan Metallurgy Society.

$$Ac_1(°\ C.)=723-10.7\times(\%\ Mn)+29.1\times(\%\ Si)+16.9\times(\%\ Cr)$$

In the above formula, (% Mn), (% Si), and (% Cr) indicate the content of each composition.

TABLE 1

| Steel | C | Si | Mn | P | S | Al | N | Ti | Nb | Cr | Mo | V | B | Ca | Sb | Remarks |
|---|---|---|---|---|---|---|---|---|---|---|---|---|---|---|---|---|
| A | 0.09 | 0.03 | 1.8 | 0.015 | 0.002 | 0.035 | 0.005 | 0.04 | | | | | | | | Example Steel |
| B | 0.12 | 0.05 | 2.2 | 0.021 | 0.003 | 0.029 | 0.004 | | 0.03 | | | | | | | Example Steel |
| C | 0.10 | 0.02 | 2.0 | 0.012 | 0.002 | 0.032 | 0.003 | 0.01 | 0.02 | 0.3 | | | | | | Example Steel |
| D | 0.07 | 0.20 | 1.4 | 0.032 | 0.004 | 0.041 | 0.012 | 0.02 | 0.05 | | 0.2 | | | | | Example Steel |
| E | 0.13 | 0.05 | 2.1 | 0.042 | 0.003 | 0.033 | 0.004 | 0.1 | 0.05 | | | 0.05 | | | | Example Steel |
| F | 0.10 | 0.12 | 2.5 | 0.015 | 0.001 | 0.039 | 0.006 | 0.06 | | | | | 0.002 | | | Example Steel |
| G | 0.09 | 0.01 | 2.0 | 0.021 | 0.002 | 0.045 | 0.005 | | 0.07 | | | | | 0.003 | | Example Steel |
| H | 0.05 | 0.08 | 2.2 | 0.016 | 0.002 | 0.025 | 0.004 | 0.04 | 0.04 | | | | | | 0.004 | Example Steel |
| I | 0.09 | 0.04 | 1.8 | 0.035 | 0.003 | 0.031 | 0.005 | | | | | | | | | Steel of comparative examle |
| J | 0.03 | 0.02 | 1.8 | 0.023 | 0.002 | 0.051 | 0.003 | 0.04 | | | | | | | | Steel of comparative examle |
| K | 0.13 | 0.53 | 1.8 | 0.021 | 0.002 | 0.045 | 0.003 | 0.04 | 0.05 | | | | | | | Steel of comparative examle |
| L | 0.08 | 0.03 | 0.7 | 0.025 | 0.003 | 0.050 | 0.006 | | 0.07 | | | | | | | Steel of comparative examle |

TABLE 2

| | | | Hot rolling conditions | | | Cold rolling conditions | Annealing conditions | |
|---|---|---|---|---|---|---|---|---|
| No. | Steel | $Ac_1$ Transformation point (° C.) | Slab heating temperature (° C.) | Finish rolling temperature (° C.) | Coiling temperature (° C.) | Rolling reduction ratio | Line | Dew point at temperatures of 600° C. or more (° C.) |
| 1 | A | 705 | 1280 | 870 | 550 | 60 | CAL | −45 |
| 2 | A | | 1150 | 870 | 570 | 60 | CAL | −47 |
| 3 | A | | 1230 | 870 | 590 | 60 | CAL | −45 |
| 4 | A | | 1250 | 770 | 550 | 60 | CAL | −45 |
| 5 | B | 701 | 1250 | 840 | 580 | 55 | CGL | −45 |
| 6 | B | | 1230 | 840 | 700 | 55 | CGL | −45 |
| 7 | B | | 1200 | 840 | 470 | 55 | CGL | −45 |
| 8 | B | | 1200 | 840 | 500 | 20 | CGL | −45 |
| 9 | C | 707 | 1220 | 850 | 610 | 40 | CAL | −40 |
| 10 | C | | 1240 | 850 | 590 | 40 | CAL | −46 |
| 11 | D | 714 | 1300 | 900 | 500 | 75 | CGL | −45 |
| 12 | D | | 1280 | 900 | 580 | 75 | CGL | −46 |
| 13 | E | 702 | 1290 | 880 | 590 | 60 | CAL | −45 |
| 14 | E | | 1270 | 880 | 550 | 60 | CAL | −47 |
| 15 | E | | 1270 | 880 | 550 | 60 | CAL | −48 |
| 16 | F | 700 | 1230 | 860 | 580 | 70 | CGL | −48 |
| 17 | F | | 1230 | 860 | 580 | 70 | CGL | −50 |
| 18 | G | 702 | 1250 | 870 | 420 | 50 | CAL | −51 |
| 19 | G | | 1250 | 870 | 550 | 50 | CAL | −48 |
| 20 | H | 702 | 1220 | 850 | 580 | 60 | CGL | −47 |
| 21 | H | | 1230 | 850 | 560 | 60 | CGL | −37 |
| 22 | I | 705 | 1250 | 850 | 540 | 60 | CAL | −48 |
| 23 | J | 704 | 1220 | 850 | 500 | 60 | CGL | −49 |
| 24 | K | 716 | 1270 | 880 | 580 | 60 | CAL | −55 |
| 25 | L | 716 | 1210 | 900 | 470 | 60 | CGL | −52 |

| | Annealing conditions | | | | Alloying condition | |
|---|---|---|---|---|---|---|
| No. | Average heating rate from 500° C. to $Ac_1$ Transformation point (° C./s) | Heating temperature (° C.) | Retention time (s) | Average cooling rate from 750° C. to 550° C. (° C./s) | Alloying temperature (° C.) | Time (s) |
| 1 | 25 | 810 | 150 | 10 | — | — |
| 2 | 22 | 810 | 150 | 10 | — | — |
| 3 | 3 | 810 | 150 | 10 | — | — |
| 4 | 20 | 810 | 150 | 10 | — | — |
| 5 | 12 | 830 | 60 | 5 | 520 | 30 |
| 6 | 12 | 820 | 90 | 7 | 520 | 30 |

TABLE 2-continued

| | | | | | | |
|---|---|---|---|---|---|---|
| 7 | 4 | 840 | 120 | 5 | 520 | 30 |
| 8 | 12 | 830 | 90 | 7 | 520 | 30 |
| 9 | 20 | 780 | 180 | 12 | — | — |
| 10 | 6 | 850 | 120 | 12 | — | — |
| 11 | 10 | 760 | 180 | 15 | 500 | 40 |
| 12 | 10 | 700 | 120 | 10 | 500 | 40 |
| 13 | 20 | 820 | 150 | 10 | — | — |
| 14 | 20 | 930 | 150 | 12 | — | — |
| 15 | 5 | 880 | 150 | 12 | — | — |
| 16 | 25 | 800 | 120 | 10 | — | — |
| 17 | 15 | 760 | 3 | 10 | — | — |
| 18 | 18 | 790 | 100 | 15 | — | — |
| 19 | 18 | 820 | 120 | 1 | — | — |
| 20 | 28 | 840 | 120 | 20 | 540 | 20 |
| 21 | 5 | 820 | 120 | 15 | 540 | 20 |
| 22 | 12 | 840 | 150 | 15 | — | — |
| 23 | 15 | 800 | 120 | 10 | 500 | 40 |
| 24 | 12 | 820 | 90 | 15 | — | — |
| 25 | 20 | 830 | 120 | 12 | 520 | 30 |

For the steel sheets obtained as described above, tensile properties, fatigue properties, steel sheet microstructure, and nano-hardness were measured in the following manner.

The tensile test was carried out at a strain rate of $10^{-3}$/s using JIS No. 5 test pieces sampled from a direction perpendicular to the rolling direction of the steel sheet to measure TS (tensile strength) and El (elongation). The test pieces were qualified when TS was 590 MPa or more, and the product of multiplying TS by EL is 15,000 MPa·% or more.

The fatigue properties were evaluated by a ratio (FL/TS) of a fatigue limit (FL) measured by a reversed plane bending test with a frequency of 20 Hz to the tensile strength (TS). The test pieces were qualified when the FL/TS was 0.48 or more.

The cross-sectional microstructures of the steel sheet were exposed using a 3% nital solution and were imaged at the location of ¼ in the thickness direction of the steel sheet from the surface (location corresponding to one quarter of the thickness of the steel sheet from the surface) using a scanning electron microscope (SEM) at a magnification of 3,000, and the area ratio of ferrite and martensite was quantified from the imaged structure photograph.

The nano-hardness was measured 49 to 56 points (7 points×7 or 8 points) at the location of ¼ in the plate thickness direction from the surface (location corresponding to one quarter of the thickness of the steel sheet from the surface) with intervals of 3 to 5 μm using TRIBOSCOPE manufactured by Hysitron Inc. The load was mainly set to 1,000 μN so that indentation was a triangle with one side of 300 to 800 nm, and the load was set to 500 μN when a part of indentation was more than 800 nm. The measurement of nano-hardness was performed at positions excluding grain boundaries and boundaries between different phases. The standard deviation σ was obtained from n pieces of hardness data x using formula (1) described above.

The results are shown in Table 3.

TABLE 3

| | Steel structure | | | | Tensile characteristics | | | Fatigue | |
|---|---|---|---|---|---|---|---|---|---|
| No. | Ferrite area ratio (%) | Martensite area ratio (%) | Other phases | Standard deviation of nano-hardness (GPa) | TS (MPa) | El (%) | TS × EL (MPa · %) | properties FL/TS | Remarks |
| 1 | 82 | 18 | | 1.05 | 720 | 26 | 18720 | 0.52 | Present Example |
| 2 | 77 | 23 | | 1.83 | 750 | 24 | 18000 | 0.43 | Comparative Example |
| 3 | 74 | 26 | | 1.89 | 830 | 21 | 17430 | 0.42 | Comparative Example |
| 4 | 80 | 20 | | 1.79 | 730 | 25 | 18250 | 0.43 | Comparative Example |
| 5 | 70 | 30 | | 1.26 | 930 | 18 | 16740 | 0.49 | Present Example |
| 6 | 66 | 34 | | 1.95 | 965 | 17 | 16405 | 0.42 | Comparative Example |
| 7 | 62 | 38 | | 1.68 | 1035 | 16 | 16560 | 0.44 | Comparative Example |
| 8 | 72 | 28 | | 1.75 | 940 | 16 | 15040 | 0.45 | Comparative Example |
| 9 | 75 | 25 | | 1.14 | 845 | 22 | 18590 | 0.51 | Present Example |
| 10 | 71 | 29 | | 1.77 | 880 | 20 | 17600 | 0.45 | Comparative Example |
| 11 | 78 | 12 | Bainite | 1.41 | 630 | 27 | 17010 | 0.48 | Present Example |
| 12 | 70 | 0 | Perlite | 0.63 | 435 | 34 | 14790 | 0.45 | Comparative Example |
| 13 | 80 | 20 | | 1.02 | 755 | 24 | 18120 | 0.51 | Present Example |
| 14 | 43 | 57 | | 1.77 | 1250 | 12 | 15000 | 0.41 | Comparative Example |
| 15 | 72 | 28 | | 1.86 | 860 | 20 | 17200 | 0.44 | Comparative Example |
| 16 | 60 | 40 | | 1.26 | 1120 | 14 | 15680 | 0.52 | Present Example |
| 17 | 55 | 0 | Perlite | 0.67 | 420 | 35 | 14700 | 0.45 | Comparative Example |
| 18 | 84 | 16 | | 1.32 | 655 | 28 | 18340 | 0.50 | Present Example |
| 19 | 82 | 5 | Perlite | 1.05 | 415 | 36 | 14940 | 0.47 | Comparative Example |
| 20 | 85 | 15 | | 0.96 | 615 | 30 | 18450 | 0.53 | Present Example |
| 21 | 82 | 18 | | 1.71 | 580 | 27 | 17550 | 0.44 | Comparative Example |
| 22 | 73 | 27 | | 1.54 | 825 | 21 | 17325 | 0.43 | Comparative Example |
| 23 | 95 | 5 | | 1.26 | 360 | 39 | 14040 | 0.46 | Comparative Example |
| 24 | 74 | 26 | | 1.08 | 850 | 21 | 17850 | 0.45 | Comparative Example |
| 25 | 88 | 3 | Perlite | 0.93 | 340 | 37 | 12580 | 0.44 | Comparative Example |

As shown in Table 3, all of the steel sheets and the plated steel sheets obtained according to the present examples have high tensile strength of 590 MPa or more and excellent fatigue properties. The relationship between the standard deviation of nano-hardness in the steel sheet microstructure and FL/TS is shown in FIG. 1. As shown in FIG. 1, it can be understood that the present examples show FL/TS of 0.48 or more and the fatigue properties are excellent. Further, it can be understood that the FL/TS is high and the fatigue properties are further excellent in the present examples in which the average heating rate is 20° C./s or more at 500° C. to $Ac_1$ transformation temperature.

As a result of similar measurement on the surface layer of the base steel, the standard deviation σ of nano-hardness was 1.50 GPa or lower in the present examples. In sharp contrast, the standard deviation σ of nano-hardness on the surface was more than 1.50 GPa under the condition that the dew point was more than −40° C.

The invention claimed is:

1. A steel sheet having a chemical composition comprising, by mass %:

C: 0.04% or more and 0.15% or less;

Si: 0.3% or less;

Mn: 1.0% or more and 2.6% or less;

P: 0.1% or less;

S: 0.01% or less;

Al: 0.01% or more and 0.1% or less;

N: 0.015% or less;

at least one of Ti and Nb: 0.01% or more and 0.07% or less in total; and a balance being Fe and unavoidable impurities, wherein the steel sheet has a steel microstructure of 50% or more of ferrite and in a range of 10% or more and 50% or less of martensite in terms of an area ratio, a standard deviation of nano-hardness of the steel microstructure is 1.50 GPa or less, the steel sheet has a tensile strength of 590 MPa or more, the steel sheet has FL/TS of 0.51 or more and EL×TS of 15000 MPa·% or more, where FL is a fatigue limit, EL is an elongation, and TS is the tensile strength.

2. The steel sheet according to claim 1, wherein the chemical composition further comprises, by mass %, at least one Group selected from a group consisting of A, B and C:

Group A: at least one selected from the group consisting of:

Cr: 0.05% or more and 1.0% or less,

Mo: 0.05% or more and 1.0% or less, and

V: 0.01% or more and 1.0% or less,

Group B:

B: 0.0003% or more and 0.005% or less, and

Group C: at least one selected from the group consisting of:

Ca: 0.001% or more and 0.005% or less, and

Sb: 0.003% or more and 0.03% or less.

3. A plated steel sheet comprising a plating layer disposed on a surface of the steel sheet of claim 1.

4. A plated steel sheet comprising a plating layer disposed on a surface of the steel sheet of claim 2.

5. The plated steel sheet according to claim 3, wherein the plating layer is a hot-dip galvanized layer.

6. The plated steel sheet according to claim 4, wherein the plating layer is a hot-dip galvanized layer.

7. The plated steel sheet according to claim 5, wherein the hot-dip galvanized layer is a hot-dip galvannealed layer.

8. A method of producing the steel sheet to produce the steel sheet according to claim 1, the method comprising:

heating a steel slab having the chemical composition to a temperature in a range of 1,200° C. or higher and 1,350° C. or lower and then subjecting the steel slab to finish rolling at a finish rolling temperature of 800° C. or higher to produce a hot-rolled steel sheet; and subsequently coiling the hot-rolled steel sheet at a coiling temperature in a range of 400° C. or higher and 650° C. or lower.

9. The method according to claim 8, further comprising cold rolling the hot-rolled steel sheet at a cold-rolling reduction ratio in a range of 30 to 95% to produce a cold-rolled full hard steel sheet.

10. The method according to claim 9, further comprising:

heating the cold-rolled full hard steel sheet up to a temperature in a range of 730 to 900° C. at a dew point of −40° C. or lower in a temperature range of 600° C. or higher and at an average heating rate of 20° C./s or more in a temperature range from 500° C. to an $Ac_1$ transformation temperature;

retaining the heated cold-rolled full hard steel sheet for 10 seconds or longer; and subsequently cooling the cold-rolled full hard steel sheet from 750° C. to 550° C. at an average cooling rate of 3° C./s or more and 20° C./s or less in a cooling.

11. A method for producing a plated steel sheet, the method comprising plating the steel sheet obtained by the method of claim 10.

12. The method according to claim 11, wherein the plating includes hot-dip galvanizing.

13. The method according to claim 12, further comprising alloying for a duration in a range of 5 to 60 s in a temperature range of 480 to 560° C. after the hot-dip galvanizing.

14. The plated steel sheet according to claim 6, wherein the hot-dip galvanized layer is a hot-dip galvannealed layer.

15. A method of producing the steel sheet according to claim 2, the method comprising:

heating a steel slab having the chemical composition to a temperature in a range of 1,200° C. or higher and 1,350° C. or lower and then subjecting the steel slab to finish rolling at a finish rolling temperature of 800° C. or higher to produce a hot-rolled steel sheet; and subsequently coiling the hot-rolled steel sheet at a coiling temperature in a range of 400° C. or higher and 650° C. or lower.

16. The method according to claim 15, further comprising cold rolling the hot-rolled steel sheet at a cold-rolling reduction ratio in a range of 30 to 95% to produce a cold-rolled full hard steel sheet.

17. The method according to claim 16, further comprising:

heating the cold-rolled full hard steel sheet up to a temperature in a range of 730 to 900° C. at a dew point of −40° C. or lower in a temperature range of 600° C. or higher and at an average heating rate of 20° C./s or more in a temperature range from 500° C. to an $Ac_1$ transformation temperature;

retaining the heated cold-rolled full hard steel sheet for 10 seconds or longer; and subsequently cooling the cold-rolled full hard steel sheet from 750° C. to 550° C. at an average cooling rate of 3° C./s or more and 20° C./s or less in a cooling.

18. A method for producing a plated steel sheet, the method comprising plating the steel sheet obtained by the method of claim 17.

19. The method according to claim 18, wherein the plating includes hot-dip galvanizing.

20. The method according to claim 19, further comprising alloying for a duration in a range of 5 to 60 s in a temperature range of 480 to 560° C. after the hot-dip galvanizing.

21. The steel sheet according to claim 1, wherein the chemical composition further comprises at least one of Ti and Nb: 0.03% or more and 0.07% or less in total.

* * * * *